United States Patent [19]

Schaeffer

[11] Patent Number: 4,655,465

[45] Date of Patent: Apr. 7, 1987

[54] ICE SKATE

[75] Inventor: Gaston Schaeffer, Klosters, Switzerland

[73] Assignee: Lyle Giffin, Blenheim, Canada

[21] Appl. No.: 803,602

[22] Filed: Dec. 2, 1985

[51] Int. Cl.[4] ..... A63C 17/18

[52] U.S. Cl. ..... 280/11.12; 36/115

[58] Field of Search ..... 36/89, 115, 117; 280/11.12, 11.3, 11.17, 11.18

[56] References Cited

U.S. PATENT DOCUMENTS

| | | | |
|---|---|---|---|
| 1,546,551 | 7/1925 | Petri | 36/89 X |
| 1,549,382 | 8/1925 | Riddell | 36/89 |
| 1,610,700 | 12/1926 | Morton | 36/89 |
| 1,986,580 | 1/1935 | Johnson | 36/115 X |
| 3,108,385 | 10/1963 | Teufel | 36/50 |
| 3,419,974 | 1/1969 | Lange | 36/89 X |
| 3,537,716 | 11/1970 | Norgiel | 280/11.3 |

FOREIGN PATENT DOCUMENTS

| | | | |
|---|---|---|---|
| 1066500 | 11/1979 | Canada | 36/115 |

*Primary Examiner*—John J. Love
*Assistant Examiner*—Michael Mar

[57] ABSTRACT

Increased forward and rearward flex of a skate boot about the ankle joint is provided while maintaining sufficient lateral support. This flex is provided by preferably removing a portion of the skate in the achilles tendon region above the heel. The flex characteristics can further be improved by providing notched areas at the front of the skate to avoid buldging when the skate is flexed forwardly. A reinforcing member is applied over the cut-out region to provide supplementary lateral support but is of a shape to accommodate forward and rearward flexing. A skate of this design significantly reduces damage to the soft tissues adjacent the achilles tendon caused by restricted pivoting movement of the leg about the ankle.

20 Claims, 5 Drawing Figures

FIG. 1.
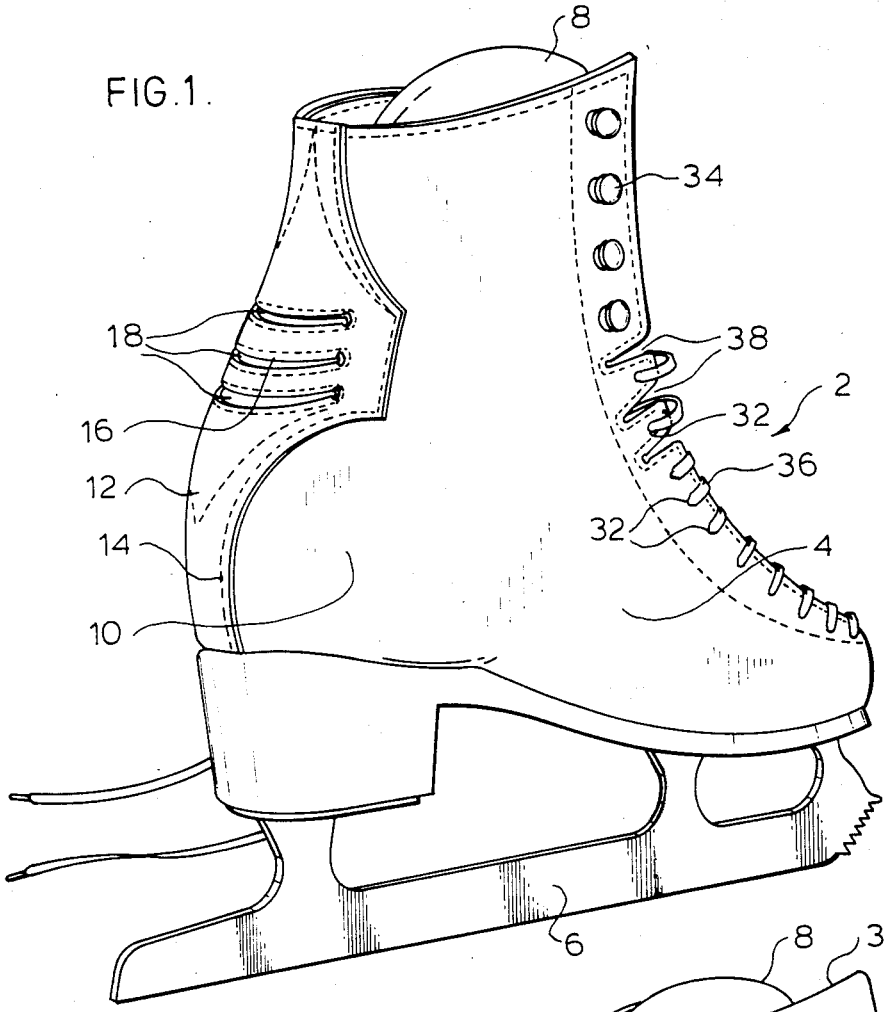
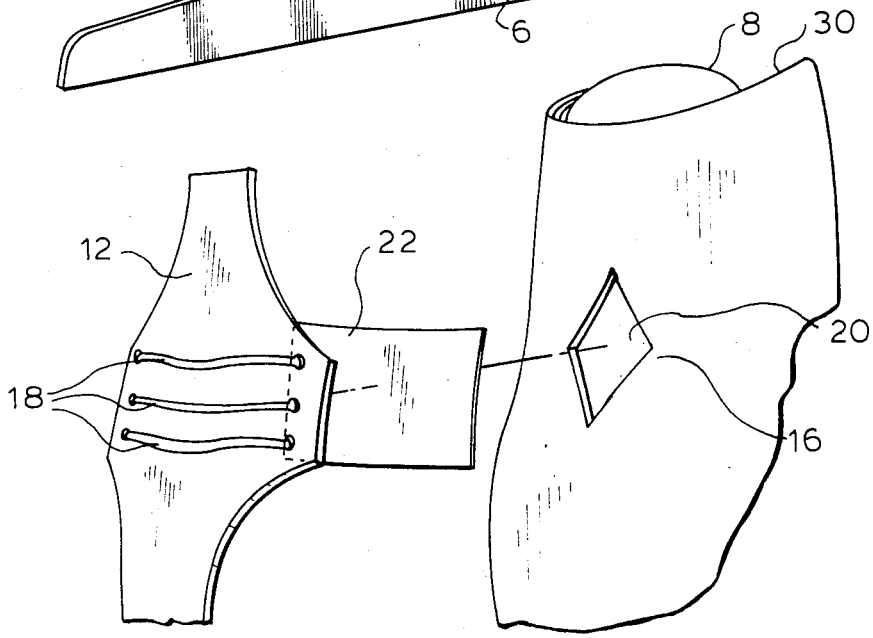
FIG. 2.

ICE SKATE

BACKGROUND OF THE INVENTION

In ice skates, it is important to provide good lateral support either side of the ankle joint and the general trend in skate design has been stronger and harder materials to enhance lateral support. In addition to lateral support, provision must be made for pivotal movement about the ankle joint, both forwardly and rearwardly to accommodate the natural movement of the skater's leg and foot. Unfortunately, this motion has been restricted by the use of these new materials reducing the effectiveness of the skater and often contributing to injuries of the soft tissues adjacent the achilles tendon region. These injuries can be extremely painful, are slow to heel and easily recur.

Some attempts have been made to provide additional movement about the ankle, for example, two piece boots have been proposed where a lower portion of the boot cooperates with an upper hinged piece whereby forward and backward movement about the ankle joint is provided. Skates of this design do work satisfactorily, however, they generally require a separate inner boot to be placed within outer moldings.

Another approach to this problem is disclosed in U.S. Pat. No. 3,537,716, which issued to Norgiel, Nov. 3, 1970, where the upper portion of the skate has an enlarged throat portion such that the upper portion of the foot can move forwardly and rearwardly within this enlarged throat portion to provide the necessary movement. With this design, there is no flexing of the upper portion of the skate as the leg merely moves within an enlarged region. This solution is not satisfactory for a number of reasons, primarily due to its inability to provide the necessary lateral support, while allowing this forward and rearward movement.

According to the present invention, the boot of the skate is weakened in the anchilles tendon region by weakening or removing a portion of the boot along the generally vertical axis of the skate. A reinforcing member, when necessary, is placed over the weakened region and is adapted to facilitate the pivoting movement about the ankle joint. The weakened area of the body reduces the force required to pivot forwardly or rearwardly and the reinforcing member, as it somewhat oversized relative to the opening, provides additional lateral support.

According to preferred aspect of the invention, the weakened area is produced by cutting out a diamond shaped region at the back of the boot, generally along the vertical axis.

According to a further aspect of the invention, the reinforcing member includes a number of generally horizontally disposed slits, which in the normal position of the skate, at least some of them have a center gap which are reduced with pivotal movement rearwardly and all gaps tend to expand with pivotal movement forwardly.

BRIEF DESCRIPTION OF THE DRAWINGS

Preferred embodiments of the invention are shown in the drawings wherein;

FIG. 1 is a perspective view of a figure skate according to the invention;

FIG. 2 is a partial exploded view of the anchilles tendon region of the figure skate;

DETAILED DESCRIPTION OF THE PREFERRED EMBODIMENTS

The ice skate 2 of the FIG. 1, is in the form of a figure skate although this invention is equally applicable to hockey skates or other forms of skates. This skate is designed to minimize or at least substantially reduce injuries to the soft tissues around the ankle joint, and it accomplishes this by providing forward and rearward flexing about the ankle joint. A weakened region generally shown as 20 in FIG. 2, is preferably a diamond shape cut-out and allows forward flexing of the boot or rearward flexing of the boot about the ankle joint. The diamond shaped cut preferably has a maximum dimension of about 2 cm. to 3 cm. and a width of about 2 cm. The width is preferably centered and generally should be less than about 4 cm. in length. Other shaped cut-out areas are possible, such as triangular, oval, circular or rectangular, as but some non limiting examples. It is somewhat desirable to have a varying width with respect to the vertical axis as this results in a predetermined maximum weakened area, which in the case of the diamond would be a horizontal line through its midpoint.

Figure 5:
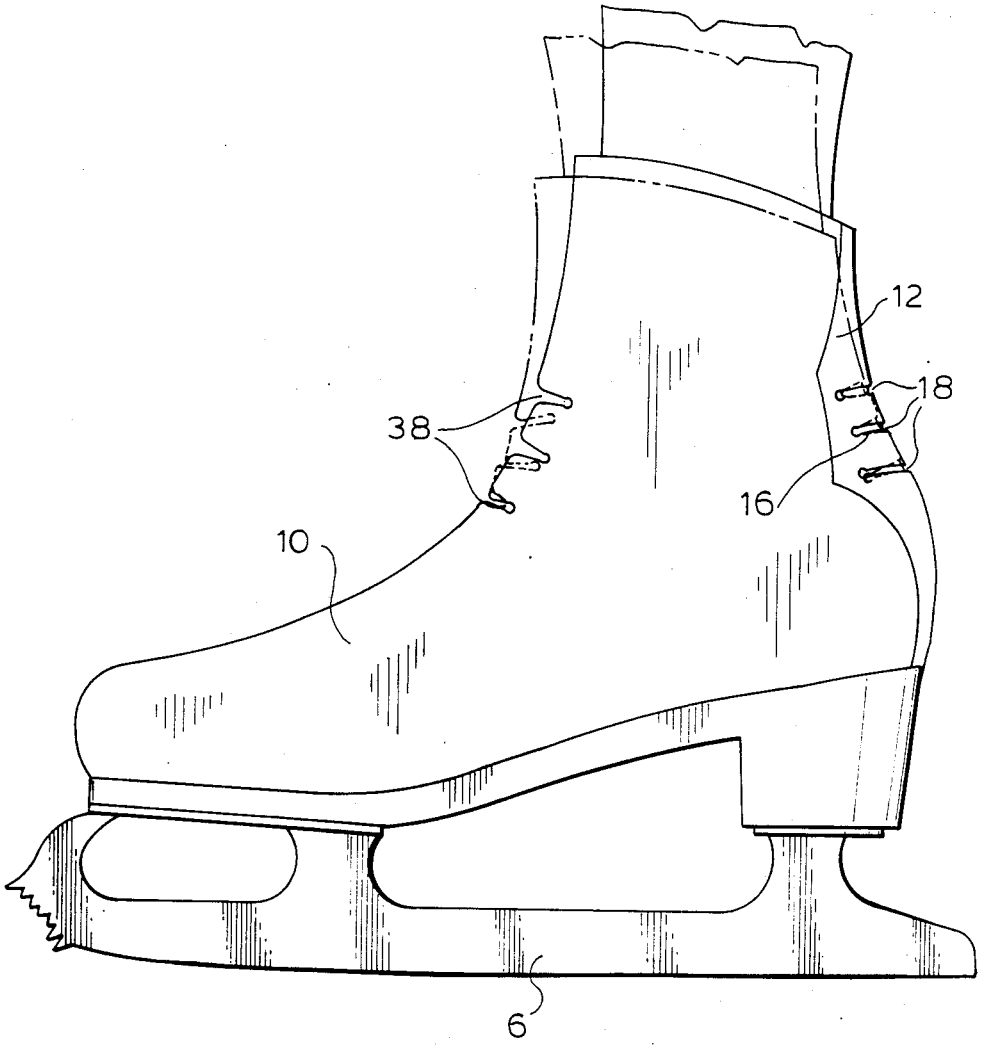
FIG. 5 is a side view of the figure skate.

The cut-out area need not be entirely removed, for example this area could be softened, slit and/or partially removed. In most cases, a cover 22 is placed over the opening to close the same, and the reinforcing member 12 covers both. The reinforcing member 12 preferably is stitched to the body portion 4 of the ice skate, and includes a number of generally horizontal slits 18 in the anchilles tendon region of the skate generally shown at 16. These slits 18 when sewn to the body of the skate have a central gap which will allow forward and rearward flexing of the skate. During forward flexing of the skate as shown in FIG. 5, the gaps tend to enlarge, and upon rearward flexing of the skate caused by pointing of the toe of the user, these gaps compress.

The reinforcing member 12 is designed to allow the forward and rearward flexing of the skate while also providing additional lateral support which may be necessary due to the portion removed. In some cases the reinforcing member may not be required.

Figure 3:
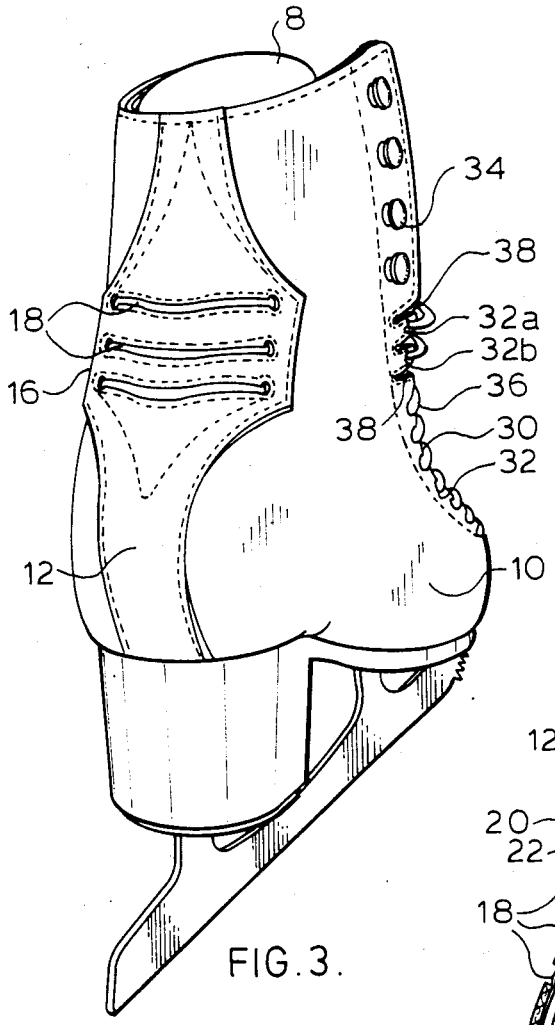
FIG. 3 is a rear perspective view of the figure skate.

To assist in the forward flexing of the boot, the front portion of the skate generally shown as 30 in FIG. 3, is quite open with the tongue 8 filling the gap at the front of the foot. This front portion either side thereof includes a plurality of fastening members in the form of eyelets 32 and fastening hooks 34 for cooperating with a lace 36 used to tighten the body portion 4 to the foot of the user. Generally, opposite the weakened area to the other side of the ankle portion, the front portion includes a number of "V" shaped notches 38 which extend rearwardly of the eyelets 32*a* and 32*b*. These notches are of increasing width from the base of the notch to the exterior and facilitate movement of the skate during flexing forward. This gap will narrow during forward flexing and will increase in width during rearward flexing. Therefore, the portion of the skate to the front of the ankle portion has been weakened with these "V" shaped notches 36, and the anchilles tendon region of the skate has been weakened with respect to forward flexing by the area 20.

Figure 4:
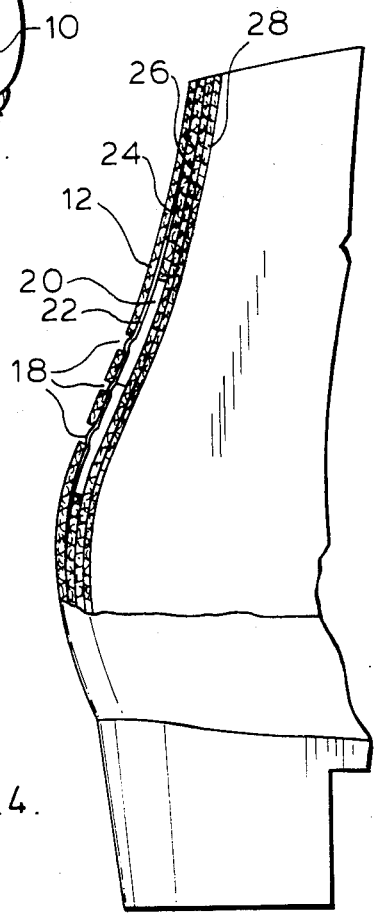
FIG. 4 is a sectional view through the heel region of the figure skate.

In the sectional view of FIG. 4, a cut through the anchilles region and heel portion of the skate is shown including the reinforcing member 12, followed by the cover member 22, followed by the outer boot layer 24 of the body portion 4, followed by a layer of padding identified as 26 and an interior liner 28. The cover member 22 is shown somewhat bulged within the gaps of each of the slits 18 and in this case acts as a barrier to water or ice entering the cut-out region.

With the skate as shown in the Figures, significant reduction in anchilles tendon injury and injury to the soft tissue therearound, has been achieved without decreasing and perhaps increasing the skaters abilities. The body portion of the skate can easily be used in the figure skate design shown, or as a hockey skate.

It is preferred that the body portion of the boot be made of leather and the reinforcing member be made of leather, however, other materials may be suitable. Certainly substantial commercial success has been achieved with various molded plastic skates and the same degree of flexing should be possible with these materials. Depending upon the material of the boot of the skate, different securing of the reinforcing member to the body portion will be used and in some cases the reinforcing member may not be required. In the case of a leather boot, it is preferred to use stitching.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. In an ice skate having a blade secured to a boot with the boot providing lateral support for the ankle of a user and covering the achilles tendon region above a heel receiving portion of said boot, the improvement comprising a weakened area in the achilles tendon region straddling a vertical centerline of said boot and blade, said weakened portion reducing the strength of said boot above said heel receiving portion with respect to both lateral rigidity and forward and rearward flexing of the boot about the ankle, and a reinforcing member covering said weakened portion and secured to said boot to provide additional strength with respect to lateral rigidity at said weakened area, said reinforcing member being modified to accommodate said forward and rearward flexing of said boot about said ankle by means of a series of slits in said reinforcing member extending generally across said achilles tendon region and said weakened area.

2. In an ice skate as claimed in 1, wherein said boot is made as a substantially one piece unit and said slits extending generally horizontally

3. In an ice skate as claimed in claim 2, wherein said boot has a generally open front closed by a tongue and a plurality of fastening means either side and along the length of said open front for receiving a lace; said open front either side thereof, including at least one notched area extending interior to a line passing through said fastening means to one side of said front portion, said notched area being generally in line with the weakened area and said ankle region for increased flex of said boot about said ankle portion and reduced buckling of said body portion along said open front during forward flex of said boot.

4. In an ice skate as claimed in claim 3, wherein said weakened portion is a cut-out area having a dimension in the vertical direction of about 2 to 3 cm.

5. In an ice skate as claimed in claim 3, wherein said weakened portion is a cut-out area includes a horizontal dimension of about 2 cm. and extends either side of the achille tendon region.

6. In a ice skate as claimed in claim 3, wherein said weakened area is a cut-out area is generally diamond, triangular, oval or circular in shape.

7. In a ice skate as claimed in claim 4, wherein at least 3 "V" shaped notches are provided either side of said front with each notch intermediate adjacent fastening means.

8. In a ice skate as claimed in claim 6, wherein said boot is made of leather.

9. In a ice skate is claimed in claim 8, wherein said fastening means includes eyelets and said skate is a hockey skate or a figure skate.

10. In a ice skate as claimed in claim 9, including a thin cover sheet intermediate said cut-out area and said reinforcing member sized to fully cover said cut-out area.

11. In a ice skate as claimed in claim 10, wherein said reinforcing member includes 3 slits, the gaps defined within each slit varying in accordance with the amount of movement about the ankle portion.

12. In a ice skate as claimed in claim 11, wherein two of said slits have a generally increasing gap towards the mid point of said slits when the boot is in its normal position.

13. In a ice skate as claimed in claim 12, wherein said slits allow pivotal movement forward or back from the normal position by spreading or narrowing of the gap at the mid points of the slits.

14. In a ice skate as claimed in claim 13, wherein said reinforcing member is stitched to said boot about the periphery of the reinforcing member and about each gap.

15. An ice skate having a blade secured to a boot, the boot being of the type which extends above and provides lateral support of the ankle region of the user, said boot including a body portion having an achilles tendon region above a heel receiving portion of said body portion, said achilles tendon region having a small weakened portion adjacent the vertical axis of the boot, said weakened portion being shaped to reduce boot resistance to forward and back pivoting movement about the ankle region, said body portion including a reinforcing member extending over said weakened portion and secured to said boot, said reinforcing member having a series of slits located over said weakened portion and extending across the vertical axis to accommodate forward and rearward flexing of the boot while increasing the lateral strength of said boot.

16. An ice skate as claimed in claim 15, wherein said body portion is made as a substantially one piece unit, said slits extending generally horizontally across said vertical axis across said vertical axis.

17. An ice skate as claimed in claim 15, wherein said body has a generally open front closed by a tongue and a plurality of fastening means either side and along the length of said open front for receiving a lace; said open front either side thereof, including at least one notched area extending interior to a line passing through said fastening means to one side of said front portion, said notched area being generally in line with the weakened area and said ankle region for increased flex of said boot about said ankle portion and reduced buckling of said body portion along said open front during forward flex of said boot.

18. An ice skate as claimed in claim 15, wherein said weakened portion is a cut-out area having a dimension in the vertical direction of about 2 to 3 cm.

19. An ice skate as claimed in claim 15, wherein said weakened portion is a cut-out area having a horizontal dimension extending either side of the achilles tendon region at least about 1 cm. and less than about 2 cm.

20. An ice skate as claimed in claim 19, wherein said cut-out area has a dimension in the vertical direction of about 2 to 3 cm.

* * * * *